US006967041B1

(12) United States Patent
Jarvis et al.

(10) Patent No.: US 6,967,041 B1
(45) Date of Patent: Nov. 22, 2005

(54) METHOD OF MASKING AREAS OF AN OBJECT DURING GALVANIZING

(75) Inventors: Lonnie E. Jarvis, Omaha, NE (US); Ronie G. Hansen, Fremont, NE (US)

(73) Assignee: Valmont Industries, Inc., Valley, NE (US)

( * ) Notice: Subject to any disclaimer, the term of this patent is extended or adjusted under 35 U.S.C. 154(b) by 52 days.

(21) Appl. No.: 10/776,107

(22) Filed: Feb. 11, 2004

(51) Int. Cl.[7] ..... B05D 1/32

(52) U.S. Cl. ..... 427/282; 427/156; 427/208.6; 427/433; 427/272

(58) Field of Search ..... 427/154–156, 427/230, 234, 239, 208.6, 282, 433, 468, 427/272; 118/504

(56) References Cited

U.S. PATENT DOCUMENTS 4,047,977 A 9/1977 Yoshida et al. ..... 148/6.2
4,421,793 A 12/1983 Moroni ..... 427/272
5,091,220 A * 2/1992 Horiki et al. ..... 427/272

FOREIGN PATENT DOCUMENTS

JP 06-235055 * 8/1994

OTHER PUBLICATIONS

Power Poxy web site advertisement for Power Poxy Glue Screws, Undated.

* cited by examiner

*Primary Examiner*—Fred J. Parker

(74) *Attorney, Agent, or Firm*—Thomte, Mazour & Neibergall; Dennis L. Thomte

(57) ABSTRACT

A method of masking areas of an object during galvanizing of the object to prevent galvanizing material from adhering to the masked areas comprising the step of applying a polyurethane adhesive to the area.

8 Claims, 1 Drawing Sheet

METHOD OF MASKING AREAS OF AN OBJECT DURING GALVANIZING

BACKGROUND OF THE INVENTION

1. Field of the Invention

This invention relates to a method of masking an area of an object or member to prevent the area from being galvanized during the galvanizing of the member or object.

2. Description of the Related Art

Galvanizers have always had a very difficult time protecting threads and other areas from being galvanized on a galvanized product. In times past, the assignee of this invention, and other galvanizers, have used silicone to try and protect or mask the threads and other areas which they did not want to be galvanized during the galvanizing process. The theory behind using silicon is that it would protect the designated areas from the acid or pickling process and the flux process. Protecting these areas from these processes prevented the hot dip galvanizing from bonding to the surface. However, the process of using silicon in an attempt to protect or mask the areas is not effective. In general, about 80% of the areas protected with silicon need additional clean up, including tapping threads and reheating or melting the galvanizing off the protected areas. The failure of the prior art methods of masking areas or threads of the member being galvanized spurred the inventors named herein to develop an improved process.

SUMMARY OF THE INVENTION

The method of masking an area of a member to protect the area from being galvanized during the galvanizing of the member is disclosed and which comprises the steps of applying a polyurethane adhesive to the area prior to the galvanizing of the member. The method of this invention is ideally suited for use when tubular members such as poles or irrigation pipes are being galvanized to protect threaded openings or the like. The polyurethane adhesive is preferably comprised of hydrotreated light petroleum distillate, methylene bisphenyl diisocyanate, talc, silicon dioxide, and polyethylene polyphenyl isocyanate. The polyurethane adhesive protects the designated areas from the acid or pickling process and the flux process so that the hot dip galvanizing will not bond to the area.

It is therefore a principal object of the invention to provide an improved method of masking an area of a member to prevent the area from being galvanized during the galvanizing of the member.

Yet another object of the invention is to provide a method of the type described wherein a polyurethane adhesive is applied to the area to be protected from galvanizing.

Still another object of the invention is to provide a method of the type described which represents a distinct advantage over the prior art methods.

Yet another object of the invention is to provide a method of masking an area of a member to prevent the area from being galvanized during the galvanizing of the member and which is relatively simple to perform.

These and other objects will be apparent to those skilled in the art.

DETAILED DESCRIPTION OF THE INVENTION

Figure 1:
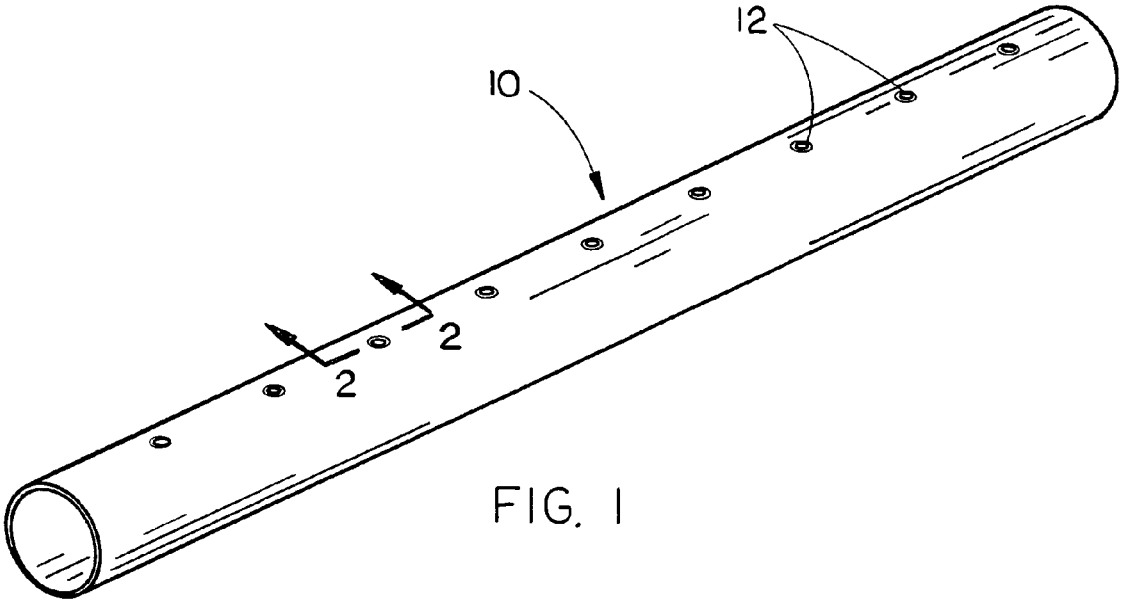
FIG. 1 is a perspective view which illustrates an object such as an irrigation pipe having threaded openings therein with it being desired to prevent the threaded openings from being galvanized during the galvanizing of the irrigation pipe.
Figure 2:
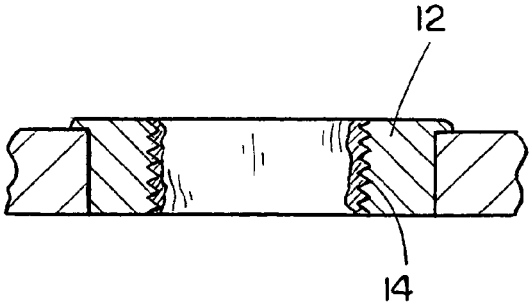
FIG. 2 is a sectional view of the threaded opening of the irrigation pipe of FIG. 1 and illustrates the polyurethane adhesive of this method having been applied to the threaded opening.
Figure 3:
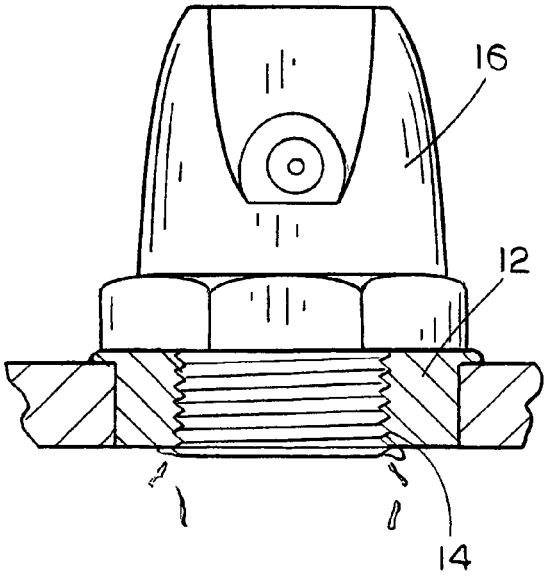
FIG. 3 is a view similar to FIG. 2 but which shows that a spray nozzle may be easily threaded into the threaded opening of FIG. 2 without clean up being required after the galvanizing of the irrigation pipe.

A method of masking an area of a member to prevent the area from being galvanized during the galvanizing of the member is disclosed herein and is especially well-suited for use with a tubular member such as the irrigation pipe 10 in FIG. 1 or with a utility pole or other type of pole wherein areas are desired to be protected or masked during the galvanizing process. For purposes of illustration, pipe 10 includes a plurality of threaded inserts or openings 12 having internal threads 14. Normally, the inserts are spaced along the length of the pipe 10 and which are adapted to receive spray nozzles, drop tubes, etc. FIG. 3 illustrates a spray nozzle 16 threaded into the threaded opening 12.

When the pipe 10 is to be galvanized, it is desirable to protect the threads 14 from being galvanized so that the threads 14 do not have to be cleaned or stripped of galvanizing material after the pipe 10 has been galvanized. As stated hereinabove, silicon was applied to the areas to be protected in the past, but silicon has not satisfactorily masked the areas to be protected. Applicants have found that the areas to be protected may be masked by applying a polyurethane adhesive to the area to be protected prior to the galvanizing of the member. Applicants have discovered that a suitable polyurethane adhesive is available from OSI Sealants, Inc., 7405 Production Drive, Mentor, Ohio 44060, and which is marketed under the designation "PL® Polyurethane Premium Construction Adhesive." The content listing on the container of PL® Polyurethane Premium Construction Adhesive is as follows: hydrotreated light petroleum distillate, methylene bisphenyl diisocyanate, talc, silicon dioxide, and polyethylene polyphenyl isocyanate. To confirm the ingredients of the PL® Polyurethane Premium Construction Adhesive, applicants authorized a chemical characterization thereof using the following techniques: (1) fourier transform infrared spectroscopy (FTIR); and (2) energy dispersive x-ray spectrometry (EDS).

Fourier Transform Infrared Spectroscopy (FTIR)

Fourier transform infrared (FTIR) spectroscopy was conducted on the PL® Polyurethane Premium Construction Adhesive using the attenuated reflectance (ATR) technique. A Nicolet Avatar 360 FTIR spectrometer was used in the analysis.

FTIR spectrometers record the interaction of infrared radiation (light) with experimental samples, measuring the frequencies at which the sample absorbs the radiation and the intensities of the absorptions. Determining these frequencies allows identification of the sample's chemical makeup, since chemical functional groups are known to absorb infrared radiation at specific frequencies.

The following IR absorption bands were identified in the spectrum:

| Wavenumber ($cm^{-1}$) | Characteristic Group(s) |
|---|---|
| 3675.7 | Amide |
| 2969.5 | C—H |
| 2864.9 | C—H |
| 2267.4 | C≡N, NC═O |
| 1728.3 | C═O |
| 1608.0 | Amide, Amine |
| 1525.1 | Benzene Ring |
| 1453.8 | $—CH_2$ |
| 1372.6 | $—C—OH_3$ |
| 1297.5 | Epoxide |
| 1224.2 | Epoxide, Ester |
| 1102.4 | Si—O |
| 1008.6 | $—CH═CH_2$ |
| 854.7 | Epoxide, Substituted Benzene |
| 814.3 | Epoxide, Substituted Benzene |
| 756.1 | Substituted Benzene |
| 667.7 | Substituted Benzene, Amide |

The FTIR spectrum is consistent with nitrogen-containing isocyanate resins, as amide and isocyanate IR absorption bands (NC═O) are present, as well as with a silicon dioxide (silica) filler, as a very strong Si—O absorption band is present.

Energy Dispersive X-Ray Spectrometry (EDS)

Energy dispersive x-ray spectrometry (EDS) was conducted on the PL® Polyurethane Premium Construction Adhesive at 20 kV accelerating potential. A Kevex EDS spectrometer interfaced to an ETEC Autoscan electron microscope was used in the analysis.

EDS systems are used in the characterization of materials through the use of ionizing radiation to excite a sample. This excitation generates x-ray energies that identify the elemental composition of the sample. Using x-ray detection equipment to count the number of x-ray photons emitted by this technique, an EDS system is able to characterize and quantify in an approximate manner the elemental composition of the sample.

It was determined that the adhesive contains the elements carbon (C), oxygen (O), magnesium (Mg) and silicon (Si). A semi-quantitative analysis using the ZAF technique is presented in the following table.

| Element | Composition (wt. %) |
|---|---|
| C | 69.3 |
| O | 27.2 |
| Mg | 1.3 |
| Si | 2.2 |

The inorganic filler present also appears to contain magnesium. The total metallic element content (Mg+Si) is less than 5% by weight.

CONCLUSIONS

The FTIR spectrum of the PL® Polyurethane Premium Construction Adhesive was consistent with the listed nitrogen-containing isocyanate resins, as amide and isocyanate (NC═O) IR absorption bands are present, and with the listed silicon dioxide (silica) filler, as a very strong Si—O absorption band is present.

The EDS spectrum of the PL® Polyurethane Premium Construction Adhesive also reveals the inorganic filler to contain magnesium as well as silica. The total metallic element content (Mg+Si) is less than 5% by weight.

Another polyurethane adhesive which was tested by applicants is that also sold by OSI Sealants, Inc. under the trademark "Glue Screws". Although the polyurethane adhesive marketed under the trademark Glue Screws performed satisfactorily, the PL® Polyurethane Premium Construction Adhesive works extremely well. The use of the polyurethane adhesive of this method has reduced the reject rate from about 80% to less than 3%. During the galvanizing process, the polyurethane adhesive prevents the galvanizing material to adhere to the surface being masked. After the product has been galvanized, very little clean up, if at all, is required. For example, the spray nozzle 16 is simply threaded into the threaded opening 12 which causes the adhesive material to separate from the threaded opening 12.

Thus it can be seen that the invention accomplishes at least all of its stated objectives.

We claim:

1. The method of masking an area of a member to prevent the area from being galvanized during the galvanizing of the member, comprising the steps of:

applying a polyurethane adhesive to the area so that said polyurethane adhesive will prevent galvanizing material from adhering to the area, upon which the polyurethane adhesive has been applied, during subsequent galvanizing of the member.

2. The method of claim 1 wherein the member is a tubular member.

3. The method of claim 1 wherein the member is a tubular member and wherein the area to be masked is a threaded opening in the tubular member.

4. The method of claim 3 wherein the tubular member is a pole.

5. The method of claim 3 wherein the tubular member is an irrigation pipe.

6. The method of claim 2 wherein the tubular member is a pole.

7. The method of masking an area of a member to prevent the area from being galvanized during the galvanizing of the member, comprising the steps of:

applying a polyurethane adhesive to the area so that said polyurethane adhesive will prevent galvanizing material from adhering to the area, upon which the polyurethane adhesive has been applied, during subsequent galvanizing of the member;

said polyurethane adhesive being comprised of hydrotreated light petroleum distillate, methylene bisphenyl diisocyanate, talc, silicon dioxide, and polyethylene polyphenyl isocyanate.

8. The method of claim 7 wherein said polyurethane adhesive also contains magnesium.

* * * * *